United States Patent [19]

Griffith

[11] Patent Number: 4,799,516

[45] Date of Patent: Jan. 24, 1989

[54] WEFF YARN FEED FOR A WEAVING LOOM

[75] Inventor: John D. Griffith, Boldon, England

[73] Assignee: Sulzer Brothers Limited, Winterthur, Switzerland

[21] Appl. No.: 72,152

[22] Filed: Jul. 10, 1987

Related U.S. Application Data

[62] Division of Ser. No. 848,921, Apr. 7, 1986, Pat. No. 4,706,716, which is a division of Ser. No. 618,046, Jun. 7, 1984, abandoned.

[30] Foreign Application Priority Data

Jun. 7, 1984 [GB] United Kingdom ..... 618046

[51] Int. Cl.[4] ..... D03D 47/36

[52] U.S. Cl. ..... 139/435; 139/452

[58] Field of Search ..... 139/435, 452; 66/125 R, 66/132 R

[56] References Cited

U.S. PATENT DOCUMENTS 4,043,361 8/1977 Scheffel ..... 139/452
4,074,730 2/1978 Mizuno ..... 139/452

FOREIGN PATENT DOCUMENTS 1562144 3/1980 United Kingdom ..... 139/452
2102458 2/1983 United Kingdom ..... 139/452

*Primary Examiner*—Henry S. Jaudon
*Attorney, Agent, or Firm*—Dann, Dorfman, Herrell and Skillman

[57] ABSTRACT

A weft yarn insertion apparatus for a weaving loom, the apparatus including a main fluid nozzle for inserting a length of weft yarn into the warp shed, a pair of nip rollers, for positively feeding the weft yarn into the main nozzle, the nip rollers being located immediately upstream of the main nozzle to enable the nip rollers to propel the leading end of the yarn through the nozzle and into the shed, and a weft yarn guide immediately upstream of the nip rollers, the guide being movable to selectively introduce and withdraw the weft yarn beteween the pair of nip rollers. The rollers are driven so as to project the weft yarn into the shed at a speed in excess of the given speed normally imparted to the yarn by the main nozzle when the yarn is introduced between the rollers. When withdrawn, the rollers permit the nozzle to project the yarn at the given speed.

5 Claims, 8 Drawing Sheets

WEFF YARN FEED FOR A WEAVING LOOM

This is a division of application Ser. No. 848,921 filed Apr. 7, 1986 now U.S. Pat. No. 4,706,716, which is a division of Ser. No. 618,046 filed June 7, 1984 now abandoned.

The present invention relates to a weaving loom, in particular a weaving loom wherein weft insertion is achieved using a pressurized fluid, conveniently compressed air.

Various aspects of the present invention are hereinafter described with reference to the accompanying drawings, in which:

FIGS. 1A and 1B collectively show a partly broken away perspective view of a loom according to the present invention as viewed from the front and one end of the loom;

Figure 1A:
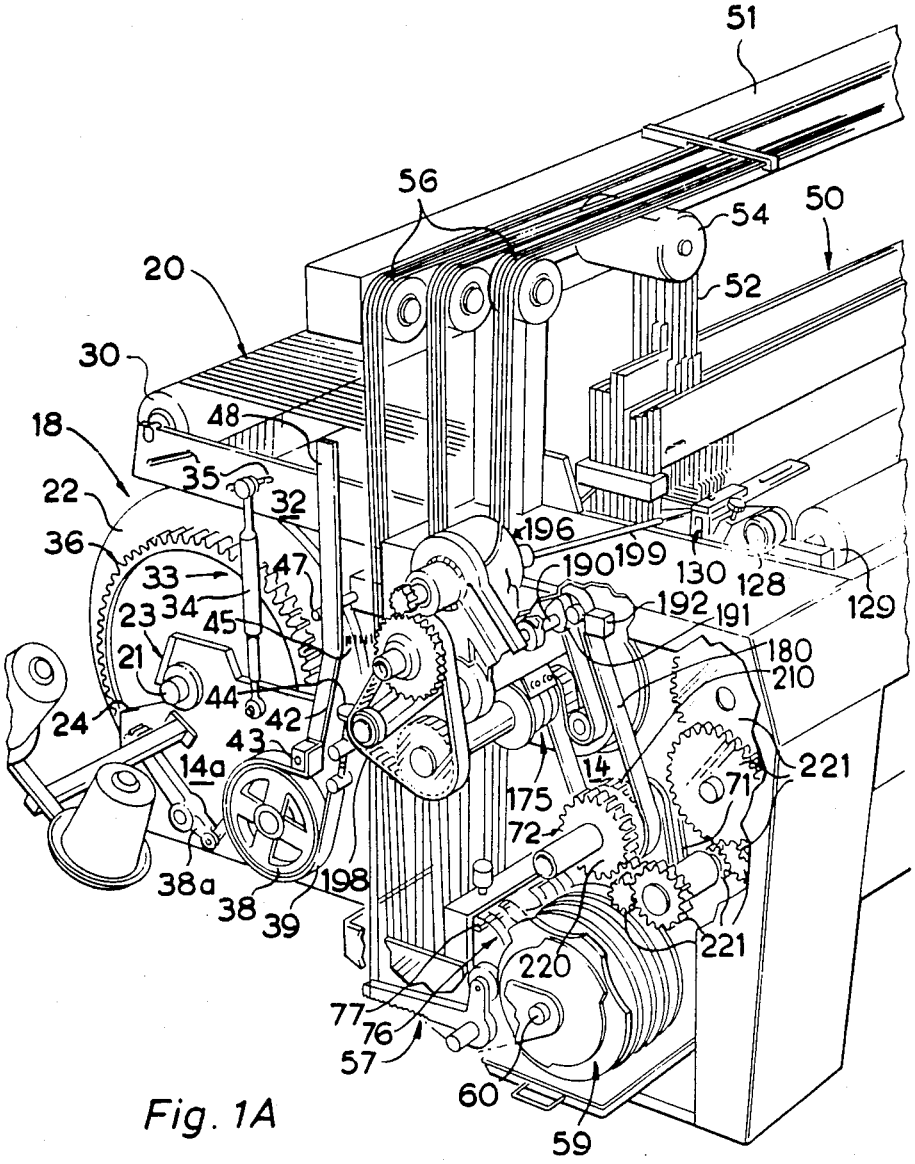

The loom has a main frame which includes a pair of end walls which are spaced apart and connected to one another by an upper cross member and lower cross member 17. The end walls are preferably formed from steel plate.

The end walls have rearwardly extending portions 14*a* which serve to rotatably support a beam 18 on which is wound the warp threads 20.

At each end of the beam 18 there is provided a disc like side wall 22 from which projects a shaft 21. During weaving each shaft 21 is rotatably received in a slot (not shown) formed in a respective side wall portion 14*a*, the shaft 21 being retained in the slot by means of a retractable slide 23. In order to facilitate loading of the reel 18 into the slots formed in side wall portions 14*a*, an inclined ramp 24 is provided in each side wall portion 14*a*. The inclination of each ramp 24 and the diameter of the discs 22 is chosen so that the shafts 21 are spaced above the outermost portion of each ramp when the discs 22 are in contact with the ground. Accordingly, a full reel 18 may be rolled to the loom and then rolled up the ramps 24 and into a working position.

The warp threads 20 extend from the reel 18 to the healds 50 of the loom via a tension sensing roller 30. The roller 30 is rotatably mounted at each end in a lever 32 which is pivotally connected at one end to a respective side wall. Each lever 32 is supported in a substantially horizontal orientation by means of compression means 33 which are preferably in the form of a gas compression spring 34. One end of the spring 34 is pivotally secured to a side wall portion 14*a* and the other end is pivotally secured to the associated lever 32. The point of attachment to the lever 32 may be adjusted by the provision of slots 35. By varying the position of attachment of the springs 34 the amount of force required to downwardly deflect levers 32 may be altered. Accordingly, the working tension in the warp threads may be adjusted by adjusting the position of attachment of springs 34 to levers 33 i.e. the nearer the point of attachment to the pivot of lever 32 the less the force required to compress the springs 34.

As seen in FIG. 1A, a gear 36 is attached to one of the discs 22 so as to be rotatable therewith. When the reel 18 is located in its working position, the gear 36 meshes with a smaller gear (not shown) which is secured to a friction wheel 38 rotatably mounted in side wall portion 14*a*. A friction band 39 extends about the periphery of the wheel 38 and is secured at one end to a lever 42 and at the other end to an adjustable anchorage 44 which enables the effective length of the band to be adjusted which in turn adjusts the working height of the sensing roller.

The lever 42 is pivotally attached at location 43 to the side wall portion 14*a* and is biased by means of a spring 45 which serves to tension the belt to frictionally grip the wheel 38. The lever 42 extends upwardly to define a handle portion 48 to enable an operative to move the lever 42 against the bias of spring 45 to thereby release the belt 39 from the wheel 38 and enable the reel 18 to be freely rotated.

A foot pedal 38*a* is provided which is engageable with wheel 38 to cause rotation therefore for manually rotating the reel 18 to increase tension in the warp yarns 20.

A stop 47 is mounted on a lever and when the roller 30 and associated levers move downwardly, the stop 47 is moved into engagement with the lever 42 and acts as a cam to deflect the lever 42 to release the belt 39. Accordingly, during weaving, as more warp threads 20 are demanded from the reel 18 supply thereof is restrained by the wheel 38 and belt 39. This causes the warp threads to deflect the roller 30 and levers 32 downwardly against the bias of springs 34. The lever 42 is thus deflected by the stop 47 and so releases the band 39 from the wheel 38 sufficiently to allow slippage and thereby allow the warp threads to be drawn from the reel. It will be appreciated therefore that the springs 34 undergo a working stroke wherein they are contracted and then extended to restore the levers 32. This working stroke dictates the tension of the warp threads and ideally springs 34 are chosen so that their bias characteristics are constant throughout this working stroke so that the tension in the warp threads remains constant irrespective of the position of the roller 30.

Figure 1B:
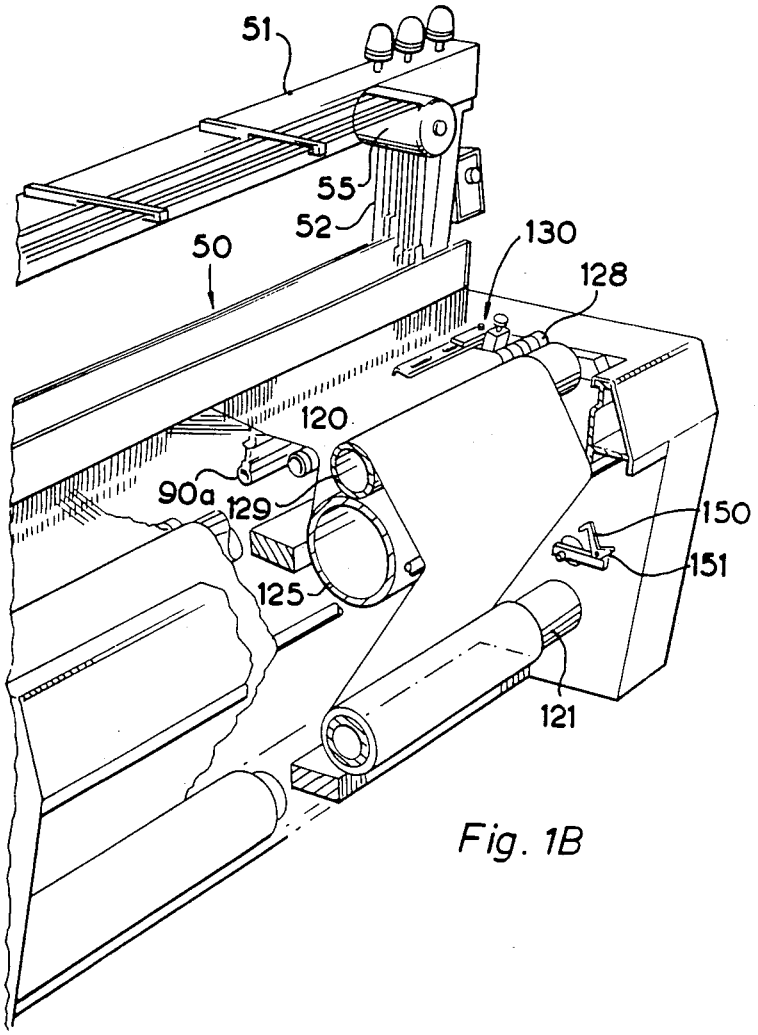

The warp threads 20 pass through a plurality of heald frames 50 which as illustrated in FIGS. 1A and 1B are of conventional construction. The heald frames 50 are each supported from an overhead frame 51 by means of a pair of cables 52 which extend via rollers 54 and 55 and a series of rollers 56 to a series of cam followers 57 which are operated by a series of cams 59 mounted on a cam shaft 60. The rollers 56 are laterally offset from one another to each co-operate with the cables extending from successive groups of cam followers. The cam shaft 60 is driven from a stub shaft via a chain 71. The stub shaft forms part of a clutch assembly 72.

Each heald frame 50 is biased downwardly by means of coiled springs (not shown) attached at one end to the heald frame and at the other end to the lower cross member. The cam follower for each heald frame is thereby maintained in contact with a respective cam. Wicks 76 are provided which contact the cams to lubricate them with oil from an oil bath 77.

A reed shaft is rotatably mounted in front of the heald frames 50 and carries a reed for beat up and also a weft insertion channel for guiding weft yarn across the warp thread sheet during weft insertion.

The reed shaft and weft insertion channel are as described in our co-pending European patent application No. 82901144 or PCT application No. 83/00046 and reference should be made thereto for details.

Figure 2:
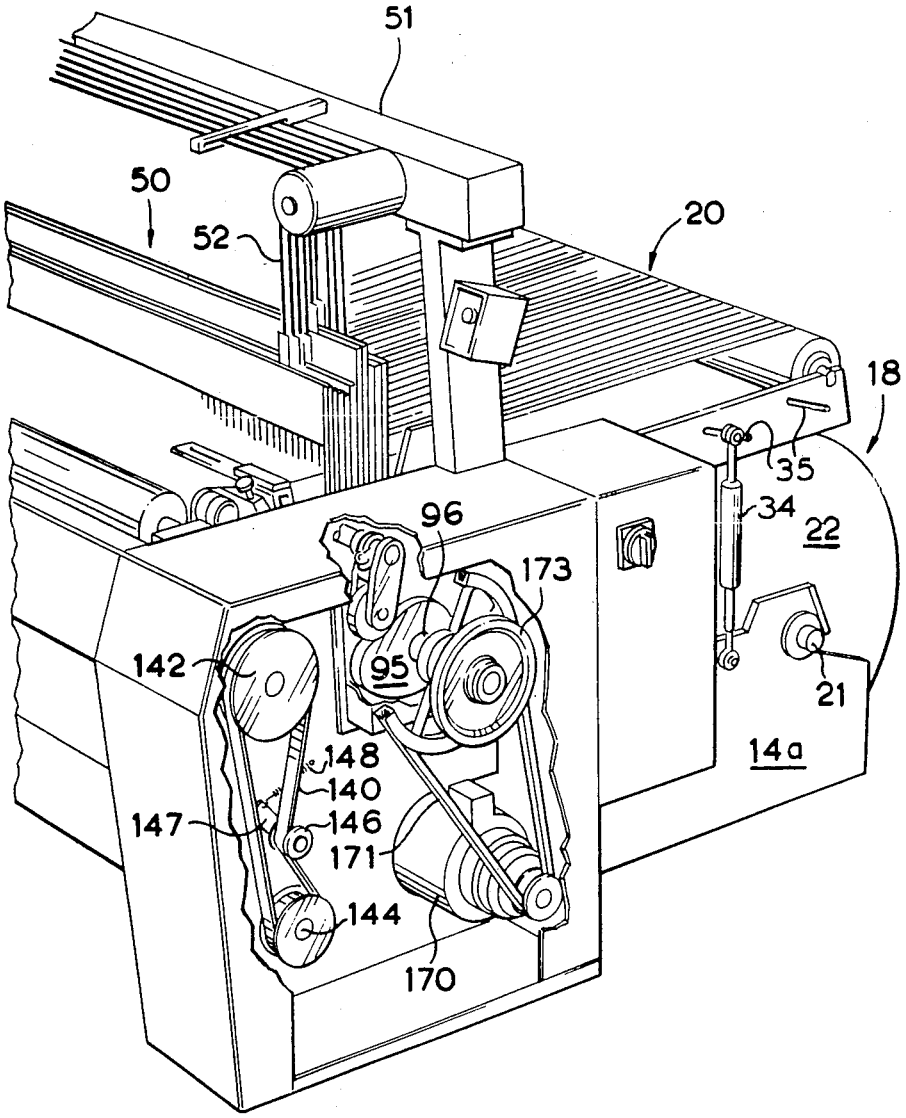
FIG. 2 is a partial perspective view of the loom shown in FIG. 1 as viewed from the front and other end of the loom.

The reed shaft is oscillated to and fro by means of a pair of cams 95 (see FIG. 2) mounted on the main drive shaft 96 of the loom. A cam follower assembly is provided at opposite ends of the reed shaft 90 for co-operation with a respective cam, so that the relative rotational positions of the cams 95 may be adjusted.

The woven fabric 120 extends from the vicinity of the reed shaft 90 to a take-up shaft 121 about which it is wound. The fabric 120 is drawn from the reed shaft 90 by a take down roller 125 which has a suitable surface for gripping the fabric. The fabric 120 is pulled tightly by the roller 125 over a ribbed bar 128 which serves to resist lateral displacement of the fabric. Additionally, the roller 125 maintains the fabric and warp sheet under tension.

Located on both sides of the fabric at a location between the bar 128 and reed shaft 90 are a pair of temples 130 of conventional construction which serve to stretch the fabric laterally prior to it passing over bar 128.

In order to provide a large surface area of grip, the fabric 120 is wrapped around a large proportion of the roller 125 and is also wrapped about a nip roller 129 prior to being fed to the cloth roll 121.

The cloth roll 121 is driven via a belt 140 which is entrained over a pulley 142 mounted on one end of the take down roller 125 and a pulley 143 mounted on a stub shaft 144 which engages with shaft 121. The belt 140 is tensioned by means of a pulley 146 mounted on a lever 147 which is biased by means of a spring 148. An operating lever 150 is provided having a cam portion 151 which is engageable with the lever 147 on deflection of lever 150 to move it against the bias of spring 148 and thereby release the tension in belt 140. It is then possible to freely rotate shaft 121.

During weaving the speed of rotation of shaft 121 will automatically vary as the diameter of the roll of fabric thereon increases.

The loom is driven by a single motor 170 which is mounted at one end of the loom and is arranged to drive the drive shaft 96 via a belt 171. A hand wheel 173 is conventiently secured to the drive shaft 96 so as to enable it to be manually rotated as for instance when initially setting up the loom.

At the opposite end of the drive shaft a plurality of stop motion sensing discs 175 are provided which sense the rotary position of the drive shaft in the event of a failure, e.g. a broken warp thread, and serve to stop the drive shaft at a desired rotary position.

The drive shaft 96 is also provided with a pulley which drives a continuous timing belt 180. The belt 180 is entrained about a rotary shaft 190 which carries cams 191 for operating valves 192 for supplying compressed air to the weft insertion air jets and for operating the release finger on the weft yarn metering device 196. The device 196 is described in detail in our co-pending Europen patent application No. 82902075. The yarn supply arms of the metering device 196 is driven from the main drive shaft 96 via a continuous belt 198. Weft yarn is supplied from the metering device 196 to an air jet nozzle 199 which is preferably constructed and arranged to operate as disclosed in our co-pending PCT patent application No. 83/00011.

The belt 180 is also entrained about a toothed pulley 210 of the clutch assembly 72. The toothed pulley 210 is located on the stub shaft and so the cam shaft 60 is directly linked to the main shaft 96 via chain 71 and belt 180.

The stub shaft 70 is arranged to drive a toothed gear 220 which in turn drives the take down roller 125 via a train of gears 221.

Figure 3:
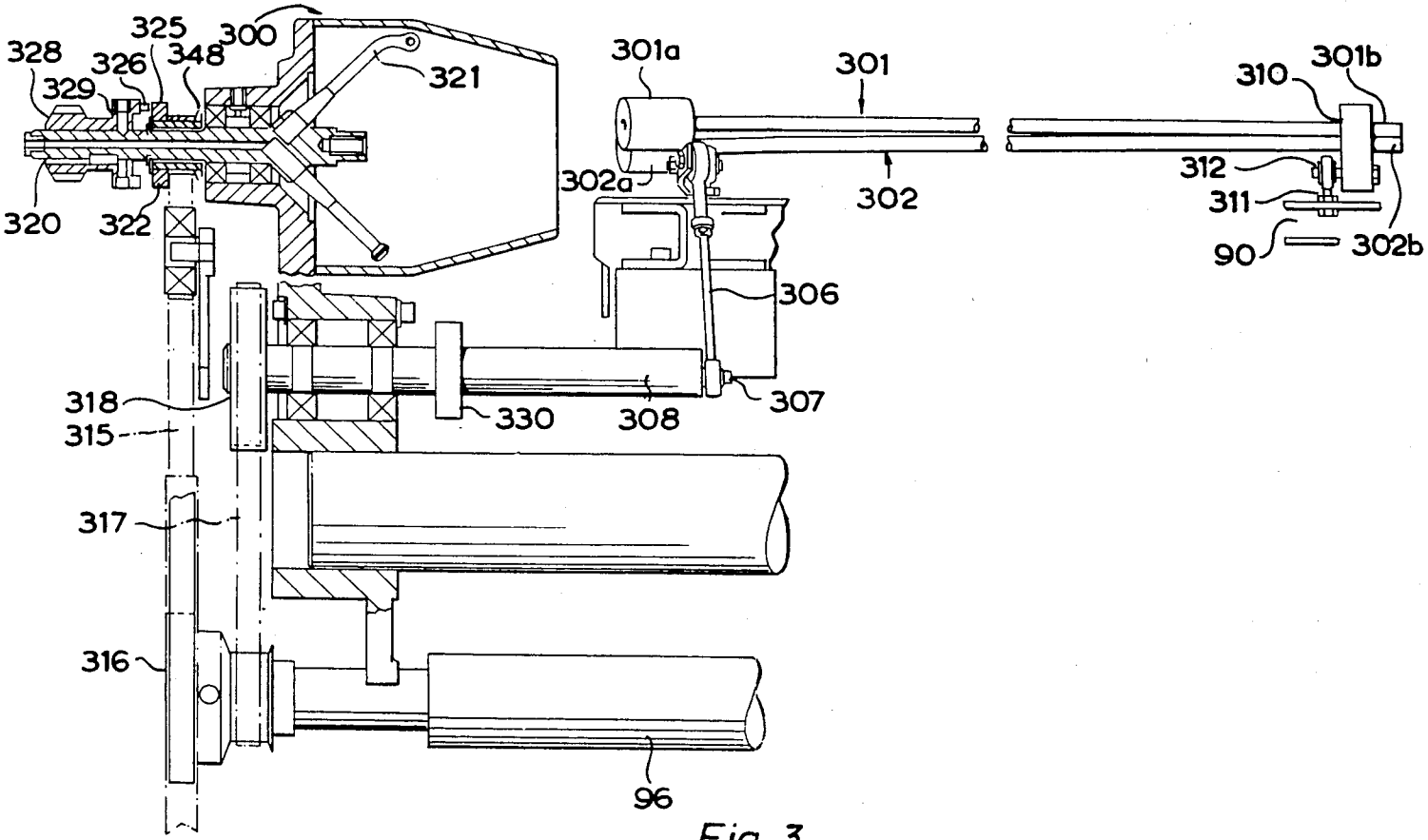
FIG. 3 is a side view, partly in section, of an alternative weft supply metering arrangement.
Figure 4:
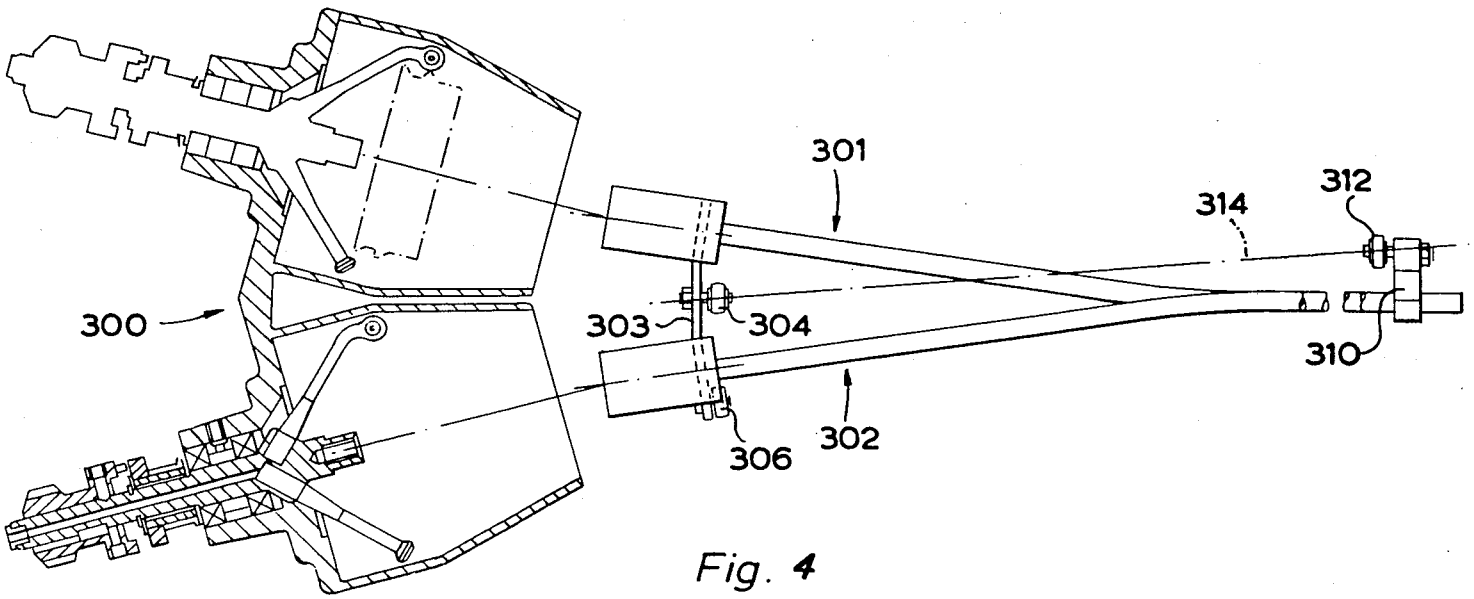
FIG. 4 is a plan view, partly in section, of the arrangement shown in FIG. 3.
Figure 5:
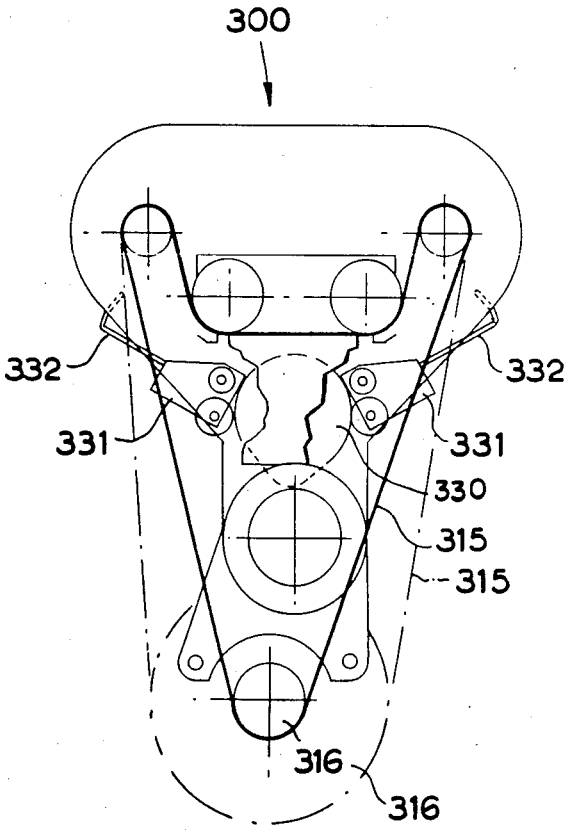
FIG. 5 is an end view, partly broken away, of the arrangement shown in FIG. 3.

As illustrated in FIGS. 3 to 5 an alternative weft metering arrangement 300 is illustrated which basically includes a pair of weft metering devices 196 arranged side by side and arranged to supply weft yarn on alternate picks of the loom. Accordingly the rate of demand of weft yarn from a respective yarn package is half that when only a single metering device is used.

In order to feed weft yarn from each metering device of arrangement 300 to the weft insertion channel it is necessary to provide a pair of air jet nozzles 301, 302 which are connected to one another at both ends. At the weft inlet end 301*a*, 302*a* of each nozzle 301, 302, the nozzles are mounted on an arm 303 which is pivotally connected to the loom frame by a spherical bearing 304. The pivotal connection is located centrally of arm 303. A push rod 306 is provided which is connected at one end to arm 303 and connected at the other end to a stub shaft 307 mounted eccentrically on shaft 308.

The discharge ends 301*b*, 302*b* of respective nozzles 301, 302 are clamped together one above the other in a clamp 310. The clamp 310 is pivotally connected via a spherical bearing 312 to a support 311 which is connected to the reed shaft 90 in a similar manner to that described in our co-pending PCT patent application No. 83/00011.

Accordingly, bearings 304, 312 co-operate to define a pivot axis 314 so that on rotation of shaft 308 the pair of nozzles are reciprocated about pivot axis 314 to thereby cause nozzle ends 301*a*, 302*a* to alternately rise and fall.

The arrangement is chosen so that at the time of weft insertion from one of the nozzles, that nozzle is correctly positioned to discharge its weft yarn into the weft insertion channel.

In order to maintain correct synchronism between the weft insertion devices they are both driven by a common continuous belt 315. As indicated in FIG. 5 it is possible to change the speed of operation of the weft insertion devices by changing the size of the pulley 316 which drives the belt 315. In this respect a larger pulley 316 is indicated in broken lines in FIG. 5.

A second belt 317 is driven by shaft 96 which is entrained about a toothed pulley 318 attached to shaft 308. Both belts 315 and 317 are timing belts so that once set up, reciprocation of arm 303 and discharge of yarn from each metering device is maintained in correct synchronism. Additionally, a cam 330 is located on shaft 308 and is arranged to drive the cam followers 331 (FIG. 5) which operate the weft release fingers 332 of respective metering devices. The cam followers 331 are spaced 180° about shaft 308 so that they operate out of phase with one another.

In order to adjust the timing of each metering device relative to reciprocation of arm 303 and fingers 332, the belt 315 is entrained about a pulley 348 associated with each metering device. Each pulley 348 is rotatably mounted on the drive shaft 320 of each device from which the yarn supply arm 321 projects and is provided with an annular clamp 322. The annular clamp 322 is provided with an axially extending recess 325 into which a pin 326 may be inserted. The pin 326 is mounted on a knob 328 which is keyed to shaft 320 but which is axially movable thereon to enable the knob 328 to be moved to insert pin 326 into recess 325 or retract pin 326 from recess 325. A spring biased ball 329 is provided for locating the knob 328 in either the pin inserted or pin retracted positions. When the knob is in the pin inserted position the pulley 348 and knob 328 rotate in unison and so arm 321 is driven via belt 315. When the knob 328 is in the pin retracted position, the shaft 320 may be rotated manually independently of shaft 96.

In order to adjust timing, the rotational position of the recess 325 may be adjusted relative to the pulley 348 by releasing clamp 322 and rotating it relative to the pulley 318 and then clamping it in position. Preferably the clamp 322 is in the form of a split collar.

In order to obtain high rates of weft yarn insertion, it is envisaged that a positive mechanical drive system may be incorporated between the weft metering device 196 and nozzle 199 which in combination with the nozzle 199 imparts to the yarn a high speed of insertion into the shed.

Figure 6:
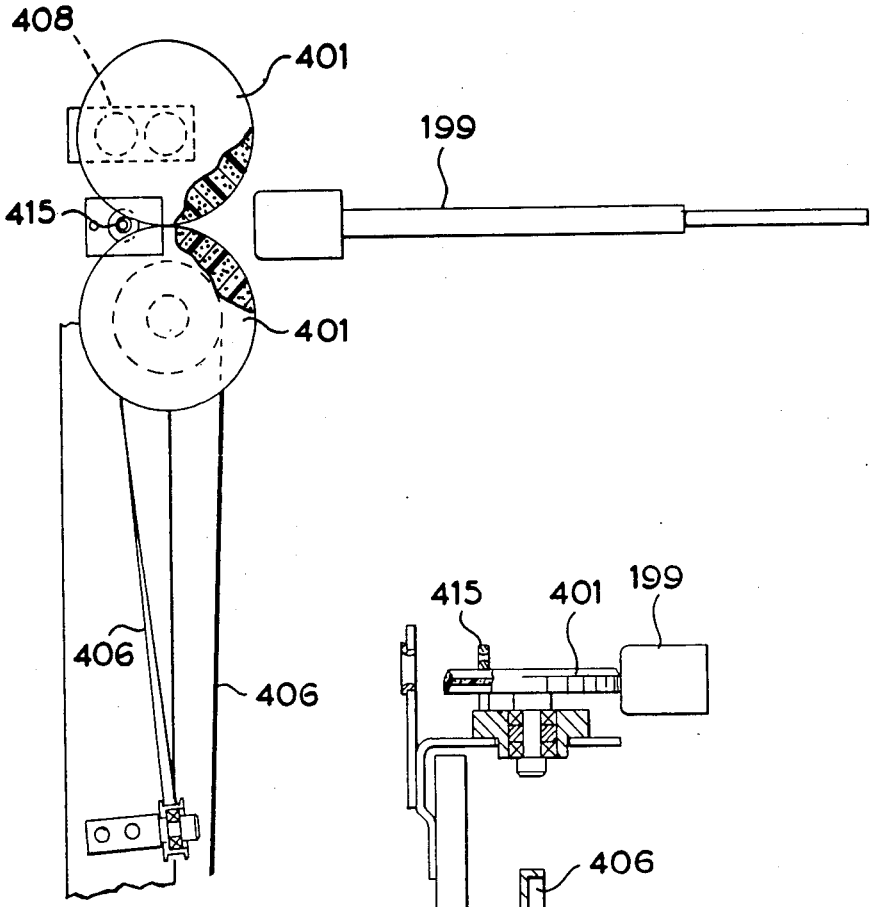
FIG. 6 is a plan view of a modification to the weft yarn insertion arrangement.

Accordingly, the drive system includes a pair of nip wheels 401 which are made of a material capable of operating at high speeds and which preferably have a surface characteristic which is wear resistant to the yarn. Preferably, the wheels 401 are formed from a polyamide filled with glass balls as indicated in FIG. 6.

One of the wheels 401 is driven from the main shaft 96 via a pulley and belt system 406 which imparts to the driven wheel 401 a high speed of revolution, for instance in the region of 20,000 revolutions per minute. The other wheel 401 is mounted on a pivoted lever 408 having bias means so as to urge the wheels into peripheral contact.

Figure 7:
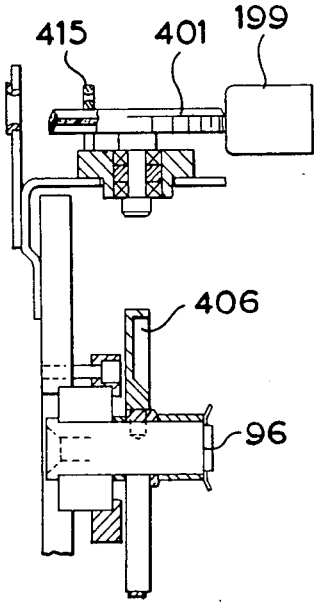
FIG. 7 is a part side view in section of the arrangement shown in FIG. 6.
Figure 8:
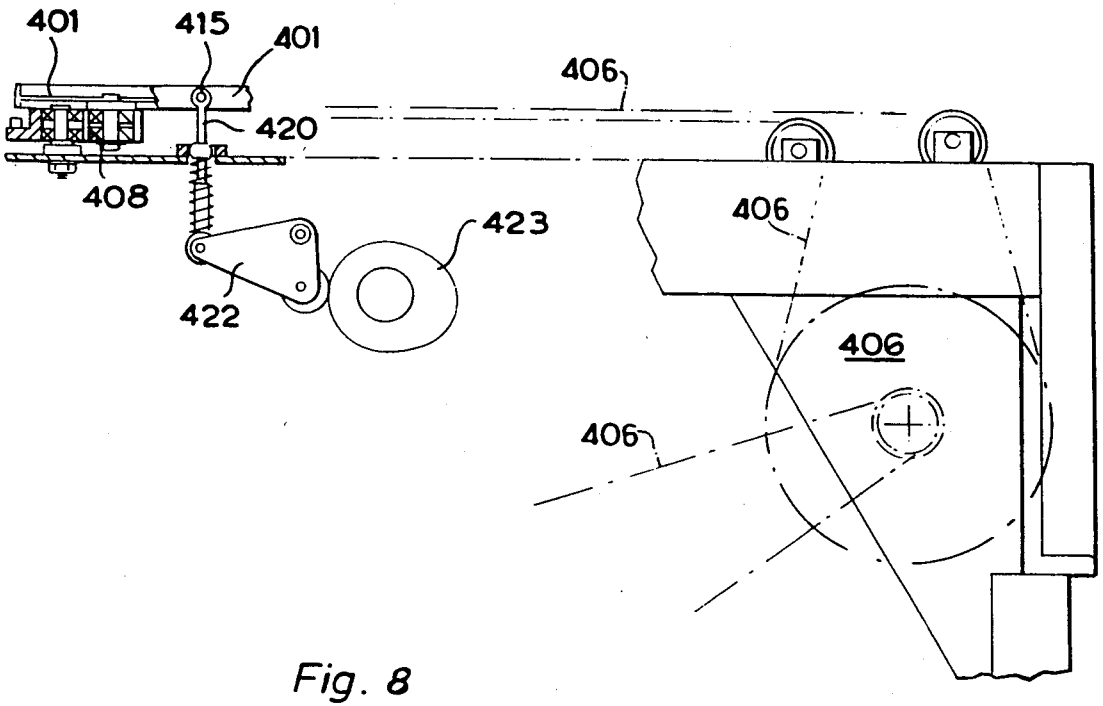
FIG. 8 is a part end view, partially shown in section of the arrangement shown in FIG. 6.

The wheels 401 are located immediately upstream of the nozzle 199 and on the side of the wheels 401 opposite to nozzle 199 there is provided a yarn guide eye 415 which is mounted on a push rod 420. The push rod 420 is connected to a cam follower 422 operated by a cam 423 so as to raise or lower the guide eye 415. When the guide eye 415 is in its raised position (as seen in FIG. 7) weft yarn is lifted free of the nip of the wheels 401 and when the guide eye 415 is in its lower position it presents the weft yarn to the nip of the wheels 401 and is therefore driven thereby.

The operational sequence of raising and lowering the eye 415 is as follows. Air to the nozzle 199 is supplied and the finger of the metering device is released. Accordingly, the nozzle begins to accelerate the weft yarn as it pulls it from the metering device 196. The eye 415 which is initially in its raised position is then lowered and the yarn is fed between the nip of the wheels 401 and is accelerated and driven thereby. After a predetermined time, the eye 415 is raised and so the yarn decelerates to a speed dictated by the nozzle 199. The nozzle 199 continues to draw yarn from the spool of the metering device until all yarn is discharged therefrom and thereafter the rate of feed of yarn is dictated by the yarn supply arm. At a predetermined time, the release finger is inserted to then stop supply of yarn and after beat up the sequence is repeated.

I claim:

1. A method of inserting weft yarn in a fluid jet loom having a main nozzle for inserting weft yarn into the warp shed, a pair of nip rollers located immediately upstream of the main nozzle and weft yarn guide means immediately upstream of the nip rollers, the guide means being movable to selectively introduce the weft yarn between the rollers for positively feeding the weft yarn to the main nozzle, wherein at the beginning of weft yarn insertion the guide means guides yarn directly to the nozzle and the nozzle is operated to accelerate the weft yarn and thereby activate insertion, the guide means is then operated to feed the yarn to the pair of nip rollers which causes the yarn to be inserted at a speed in excess of that dictated by the nozzle, the guide means is then operated at a predetermined time to disengage the yarn from the nip rollers causing the yarn to declerate to the speed of insertion dictated by the nozzle, and the nozzle is subsequently deactivated to complete the weft yarn insertion cycle.

2. A weft yarn insertion apparatus for a fluid weaving loom, said apparatus having a weft yarn metering device, a main nozzle for inserting weft yarn into the warp shed, said nozzle being controlled for a given time period to propel the weft yarn at a given speed, a pair of rollers having a nip for positively feeding the weft yarn into said main nozzle, said nip being located immediately upstream of the main nozzle so that the rollers propel the yarn from said metering device through the nozzle and into the shed, a weft yarn guide eye mounted on a push rod immediately adjacent the nip, the guide eye being selectively movable between one position spaced from said nip so as to allow the weft yarn to be drawn through the nozzle without engaging said rollers and a second position adjacent the nip so as to introduce the weft yarn into the nip of said rollers to cause the yarn to be propelled by the rollers while under the control of said nozzle, drive means for driving the nip rollers so as to propel the weft yarn at a speed in excess of said given speed when said guide eye is in said second position, and means operative to control said push rod in said second position for a period of time less than said given time period.

3. A loom according to claim 2 wherein each roller in the pair of rollers comprises a wheel formed from a polyamide filled with glass balls.

4. A loom according to claim 2 wherein said drive means drives one of said pair of rollers at a high rotational speed and includes mounting means biasing the other of said pair of rollers into peripheral contact with said driven one of said pair of rollers.

5. A loom according to claim 2 wherein said drive means drives one of said pair of rollers at a high rotational speed and includes mounting means biasing the other of said pair of rollers into peripheral contact with said driven one of said rollers.

* * * * *